US005342729A

United States Patent [19]

Aono

[11] Patent Number: 5,342,729

[45] Date of Patent: Aug. 30, 1994

[54] DYE FIXING ELEMENT WITH PROTECTIVE LAYER CONTAINING BORATE COMPOUND

[75] Inventor: Toshiaki Aono, Kanagawa, Japan

[73] Assignee: Fuji Photo Film Co., Ltd., Kanagawa, Japan

[21] Appl. No.: 988,896

[22] Filed: Dec. 10, 1992

[30] Foreign Application Priority Data

Dec. 10, 1991 [JP] Japan ..... 3-349734

[51] Int. Cl.[5] ..... G03C 5/54

[52] U.S. Cl. ..... 430/203; 430/214; 430/215; 430/216

[58] Field of Search ..... 430/203, 214, 215, 216

[56] References Cited

U.S. PATENT DOCUMENTS

| | | | |
|---|---|---|---|
| 3,239,338 | 3/1966 | Rogers | 430/216 |
| 3,295,970 | 7/1967 | Rogers | 430/215 |
| 4,704,345 | 11/1987 | Hirai et al. | 430/203 |
| 4,791,042 | 12/1988 | Aono | 430/203 |
| 5,206,131 | 4/1993 | Matsuda et al. | 430/203 |
| 5,229,246 | 7/1993 | Shibata et al. | 430/203 |

FOREIGN PATENT DOCUMENTS

| | | |
|---|---|---|
| 0426087 | 5/1991 | European Pat. Off. . |
| 61-238056 | 10/1986 | Japan . |

*Primary Examiner*—Richard L. Schilling
*Attorney, Agent, or Firm*—Sughrue, Mion, Zinn, Macpeak & Seas

[57] ABSTRACT

Disclosed is a novel dye fixing element comprising a dye fixing layer on which a diffusive dye produced or released by developing a light-sensitive element containing at least (i) a light-sensitive silver halide, (ii) a hydrophilic binder and (iii) a dye providing compound which releases a diffusive dye in correspondence to or counter correspondence to an exposure in the presence of a base and/or base precursor after or simultaneously with the imagewise exposure which is to be transferred and fixed. A borate compound is incorporated in at least a protective layer of the fixing layer provided on one side thereof.

12 Claims, No Drawings

DYE FIXING ELEMENT WITH PROTECTIVE LAYER CONTAINING BORATE COMPOUND

FIELD OF THE INVENTION

The present invention relates to a dye fixing element for use in a process in which development, particularly heat development, is effected to imagewise form a dye which is then transferred to the element to form an image.

BACKGROUND OF THE INVENTION

Silver halide system photography is superior to other photographic processes such as electrophotography and diazo processes in sensitivity and gradation adjustment and thus has heretofore been most widely used. In recent years, a technique which can easily and rapidly provide an image has been developed by changing the process for the formation of an image on a light-sensitive material from a wet process with a conventional developer or the like, to a dry process using heating or a like means.

Many methods for obtaining color images by heat development have been proposed. Methods which comprise bonding an oxidation product of a developing agent and a coupler to form a color image have been proposed in U.S. Pat. Nos. 3,531,286, 3,761,270, and 4,021,240, Belgian Patent 802,519, and Research Disclosure (Sep. 1975, page 32).

However, these methods are disadvantageous in that an image of reduced silver and a color image are formed on the heat-developed exposed portions at the same time, causing stain on the color image.

In order to eliminate this disadvantage, many approaches have been proposed, e.g., a method which comprises imagewise forming or releasing a mobile (diffusive) dye by heating, and then transferring the mobile dye to a dye fixing element having a mordant with a solvent such as water or a high boiling organic solvent or a hydrophilic heat solvent incorporated in the dye fixing element, and a method which comprises transferring a thermally-diffusive or sublimable dye to a dye receiving element such as support (U.S. Pat. Nos. 4,463,079, 4,474,867, 4,478,927, 4,507,380, 4,500,626, and 4,483,914, and JP-A-58-149046, JP-A-58-149047, JP-A-59-152440, JP-A-59-154445, JP-A-59-165054, JP-A-59-180548, JP-A-59-168439, JP-A-59-174832, JP-A-59-174833, JP-A-59-174834, and JP-A-59-174835 (the term "JP-A" as used herein means an "unexamined published Japanese patent application")).

In general, if two dye fixing elements on which an image has been formed by a transfer process such as the above mentioned image formation methods, are kept with the surfaces of their dye fixing layer sides opposed to each other, the dye image is retransferred to the opposing dye fixing layer. In particular, for the purpose of simplifying the development process, it is effective to incorporate a base or base precursor in a light-sensitive element or dye fixing element which is then subjected to heat development to form an image. However, "contact dye transfer" is worsened. Particularly, in the case where the base or base precursor is a water-soluble salt, "contact dye tranfer" is remarkably worsened.

In order to overcome this difficulty, the inventors previously proposed a dye fixing element comprising a nonionic water-soluble polysaccharide (particularly pullulan and dextran) in JP-A-62-47639 and a dye fixing element having a protective layer mainly comprising an anionic water-soluble polymer as an outermost layer in JP-A-63-103240.

The above mentioned methods have a remarkable effect on "contact dye transfer." However, if the light-sensitive material is stored under high humidity for prolonged period of time, its effect is not always sufficient. Thus, further improvements have been desired. A polymer dispersion having a glass transition temperature of 25° C. or lower may be effectively incorporated into a dye fixing layer and/or an adjacent layer in a dye fixing element without a back layer as a curl balance layer to improve the curling properties. However, this worsens "contact dye transfer."

In general, means of inhibiting "contact dye transfer" cause deterioration of transferability during the image formation, often resulting in insufficient transfer density.

SUMMARY OF THE INVENTION

It is therefore an object of the present invention to provide a dye fixing element which can provide sufficient image density without inhibiting transfer during image formation. Further, it does not suffer from "contact dye transfer" even after prolonged storage under high humidity with its dye fixing layer side surface on which an image has been formed opposed to that of another dye fixing element.

It is another object of the present invention to provide a dye fixing element which is insusceptible to worsening of "contact dye transfer" even with a base or base precursor, particularly a water-soluble base or base precursor, incorporated into the light-sensitive element or dye fixing element.

It is a further object of the present invention to provide a dye fixing element which is insusceptible to worsening of "contact dye transfer" even if a polymer dispersion having a glass transition temperature of 25° C. or lower is incorporated into the dye fixing layer or its adjacent layers for the purpose of improving the curling properties thereof.

These and other objects of the present invention will become more apparent from the following detailed description and examples.

These and other objects of the present invention are accomplished with a dye fixing element comprising, a support having thereon a dye fixing layer, said dye fixing layer having a protective layer on the side thereof opposite said support, said protective layer comprising a borate compound and a hydrophilic or water-soluble polymer having repeating units which contain at least a hydroxyl or carboxyl group, wherein the dye fixing layer is capable of receiving and having fixed thereto a diffusive dye produced or released by development of a light-sensitive element comprising (i) a light-sensitive silver halide, (ii) a hydrophilic binder, and (iii) a dye providing compound which releases a diffusive dye in correspondence to or counter correspondence to an imagewise exposure in the presence of a base or base precursor after or simultaneously with the imagewise exposure of the light-sensitive element, and, an image-fixing system comprising a light-sensitive element and a dye fixing element, said elements being in planar contact with each other, said light-sensitive element comprising a support having provided thereon a light-sensitive silver halide, a hydrophilic binder, and a dye providing compound which releases a diffusive dye in correspondence to or counter correspondence to an imagewise exposure in the presence of a base or base precursor after or simultaneously with the imagewise exposure of the light-sensitive element, and said dye fixing element comprising a support having thereon a dye fixing layer, said dye fixing layer having a protective layer on the side thereof opposite said support, said protective layer comprising a borate compound and a hydrophilic or water-soluble polymer having repeating units which contain at least a hydroxyl or carboxyl group, wherein said dye fixing layer is capable of receiving and having fixed thereto a diffusive dye produced or released by the development of said light-sensitive element.

DETAILED DESCRIPTION OF THE INVENTION

The dye fixing element of the present invention can be used as an image-receiving material in a system in which a photographic light-sensitive material comprising a light-sensitive silver halide is developed to form or release a diffusive dye which is then transferred to the image-receiving material to form an image.

This image formation system can be roughly divided into to two systems, i.e., a so-called wet color diffusion transfer process comprising development with a processing solution near ordinary temperatures and a heat development diffusion transfer process comprising heat development. The dye fixing element of the present invention is preferably used in the heat development diffusion transfer process. Thus, the dye fixing element of the present invention will be further described hereinafter with reference to the heat development diffusion transfer process. This description is also applicable to the wet color diffusion tranfer process, except for the factors peculiar to heat development such as the organic silver salt and the development process.

The dye fixing element of the present invention (hereinafter referred to as "dye fixing material" or "image receiving material") is laminated with a color light-sensitive element (hereinafter referred to as "light-sensitive material", "heat-developable light-sensitive material" or "light-sensitive element") at least during the transfer of a diffusive dye. In other words, the dye fixing layer coated side of the image receiving material comes in face-to-face contact with the light-sensitive layer coated side of the light-sensitive material at least during the transfer of a diffusive dye.

The dye fixing element of the present invention may be coated on the same or a different support as the light-sensitive element. The relationship of the dye fixing element with the light-sensitive element, the support and the dye reflecting layer, are described in U.S. Pat. No. 4,500,626, 57th column, and can be applied to the present invention. In the present invention, the dye fixing element is preferably coated on a support different from that for the light-sensitive element.

The dye fixing element comprises a dye fixing layer and a protective layer on a support, and optionally an auxiliary layer such as peel layer, crosslinking agent providing layer, interlayer, anticurl layer and back layer. One or more of these layers may comprise a hydrophilic heat solvent, a plasticizer, a discoloration inhibitor, a UV absorbent, a lubricant, a matting agent, an oxidation inhibitor, etc.

In order to inhibit "contact dye transfer" to the dye fixing element, binders and additives to be incorporated in the various layers constituting the dye fixing element, particularly the protective layer, were studied. Further, the surface shape and other properties of these layers were studied. As a result, it was found that "contact dye transfer" can be completely inhibited by incorporating a borate compound into the protective layer and/or its underlayers.

The borate compound to be used in the present invention is represented by the following general formula (A):

$$xM_2O.yB_2O_3.zH_2O \qquad (A)$$

wherein M represents a monovalent cation such as alkaline metal and ammonium; x and y each represents a positive integer; and z represents 0 or positive integer.

The borate compound represented by general formula (A) is an orthoborate, diborate, methaborate, tetraborate, pentaborate or octaborate when y/x is $\frac{1}{3}$, $\frac{1}{2}$, 1, 2, 5/4 or 4, respectively.

The above mentioned borate compound must be present in the protective layer. However, even if the borate compound is incorporated in layers under the protective layer, it will diffuse into the protective layer as the uppermost layer during drying. Therefore, the borate compound does not necessarily need to be incorporated in the protective layer during manufacture.

The binder to be incorporated in the protective layer is preferably a binder other than gelatin, especially a hydrophilic or water-soluble polymer having repeating units containing at least a hydroxyl group and/or a carboxyl group or salts thereof. In order to improve the coating properties, surface physical properties and other physical properties of the protective layer, various polymers and additives can be included in addition to the hydrophilic or water-soluble polymer.

Examples of the hydrophilic or water-soluble polymer having repeating units containing at least a hydroxyl group and/or a carboxyl group or salts thereof to be used in the present invention include synthetic high molecular compounds such as homopolymers or copolymers comprising monomer units of vinyl alcohol, acrylic acid, salts thereof, methacrylic acid, and salts thereof, natural high molecular compounds such as polysaccharides (e.g., cellulose derivative, starch, gum arabic, dextran, pullulan, agar-agar, carrageenan, gurjun gum, xanthene gum), and derivatives thereof (semi-synthetic high molecular compounds). These compounds may be used singly or in admixture.

The amount of the binder to be incorporated into the protective layer in the dye fixing element of the present invention is normally in the range of 0.01 to 2.0 g/m$^2$, preferably 0.02 to 1.0 g/m$^2$, particularly 0.05 to 0.5 g/m$^2$, as calculated in terms of dry film. The amount of the borate compound to be incorporated into the protective layer is normally in the range of 0.02 to 1.0 g/m$^2$, preferably 0.05 to 0.5 g/m$^2$, (excluding water of crystallization) depending on the dry thickness of the protective layer. If the amount of the borate compound falls below the lower limit, no effect can be obtained. On the contrary, if the amount of the borate exceeds the upper limit, it causes a granular structure possibly due to deposition of the borate compound or gelation of the polymer in the coating solution.

The layers into which the borate compound is to be incorporated are the protective layer and optionally the dye fixing layer and/or its adjacent layers. If the borate compound is incorporated into the coating solution of the dye fixing layer and/or its adjacent layers (other than a protective layer) so that the borate compound is transferred into the protective layer after coating, the amount of the borate compound used needs to be greater than when the borate compound is incorporated only into the protective layer because the borate compound only partially diffuses into the protective layer during drying after coating.

JP-A-61-238056 discloses a borate compound as a base or base precursor compound. However, this disclosure would not suggest that a protective layer comprising as a binder a hydrophilic or water-soluble polymer having repeating units containing a hydroxyl group and/or a carboxyl group or salts thereof and a borate compound causes no "contact dye transfer." Further, it is surprising that with this arrangement, even if the base or base precursor is water-soluble or a water-soluble low molecular additive which worsens "contact dye transfer" is incorporated into the dye fixing layer, "contact dye transfer" is not worsened.

In the system of the present invention, even if a borate compound is added thereto in an amount sufficient to inhibit "contact dye transfer", the development activity shows little or no change, giving little or no fluctuation in maximum density and fog, though occasionally giving an extremely small drop in the maximum density. In other words, it can be presumed that the borate compound used in an amount according to the present invention is mostly consumed in a reaction with the binder contained in the protective layer and therefore does not act as a base necessary for the development reaction.

In the present invention, the dye fixing layer comprises a polymer mordant capable of fixing a mobile dye released by development.

Examples of the polymer mordant include a polymer containing a tertiary amino group, a polymer containing a nitrogen-containing heterocyclic portion, and a polymer containing a quaternary cationic group. Such a polymer mordant is preferably used in admixture with other hydrophilic polymers (e.g., gelatin).

Polymers containing vinyl monomer units having tertiary amino groups are described in JP-A-60-60643, and JP-A-60-57836. In particular, polymers containing vinyl monomer units having tertiary imidazole groups are preferably used in view of fastness to light and transfer density. Specific examples of such polymers are described in JP-A-60-18834, JP-A-60-122941, JP-A-62-244043, and JP-A-62-244036, and U.S. Pat. Nos. 4,282,305, 4,115,124, and 3,148,061.

Preferred examples of polymers containing vinyl monomer units having quaternary imidazolium salts are described in British Patents 2,056,101, 2,093,041, and 1,594,961, U.S. Pat. Nos. 4,124,386, 4,115,124, 4,273,853, and 4,450,224, and JP-A-48-28225.

Further, preferred examples of polymers containing vinyl monomer units having quaternary ammonium salts are described in U.S. Pat. Nos. 3,709,690, 3,898,088, and 3,958,995, and JP-A-60-57836, JP-A-60-60643, JP-A-60-122940, JP-A-60-122942, and JP-A-60-235134.

The molecular weight of the polymer mordant to be used in the present invention is preferably in the range of 1,000 to 1,000,000, particularly 10,000 to 200,000.

Such a polymer mordant is incorporated into the dye fixing layer (hereinafter referred to as "mordant layer") in the image receiving material in combination with a hydrophilic colloid as a binder.

The mixing proportion of the polymer mordant to the hydrophilic colloid and the coated amount of the polymer mordant can be easily determined by those skilled in the art depending on the amount of the dye to be mordanted, the kind and composition of the polymer mordant, the image formation method to be used, etc. Preferably, the mixing proportion of the mordant to the hydrophilic colloid is in the range of 20/80 to 80/20, and the coated amount of the mordant is in the range of about 0.2 $g/m^2$ to about 15 $g/m^2$, particularly 0.5 $g/m^2$ to 8 $g/m^2$.

The polymer mordant can be incorporated into the image receiving material in combination with metallic ions to raise the transfer density of the dye. These metallic ions can be incorporated into the mordant layer containing a mordant or into adjacent layers (which may be close to or remote from the support carrying the mordant layer, etc.). These metallic ions are preferably transparent and stable to heat and light. In other words, these metallic ions are preferably polyvalent ions of transition metals such as $Cu^{2+}$, $Zn^{2+}$, $Ni^{2+}$, $Pt^{2+}$, $Pd^{2+}$and $Co^{3+}$, particularly $Zn^{2+}$. These metallic ions are normally incorporated into the system in the form of water-soluble compounds such as $ZnSO_4$ and $Zn(CH_3CO_2)_2$. The amount of these metallic ions to be added is preferably in the range of about 0.01 $g/m^2$ to about 5 $g/m^2$, more preferably 0.1 $g/m^2$ to 1.5 $g/m^2$.

The layer in which these metallic ions are located may comprise a hydrophilic polymer as a binder. As such a hydrophilic binder, there can be effectively used the hydrophilic colloid previously described with reference to the mordant layer.

The mordant layer comprising such a polymer mordant may comprise various surface active agents for the purpose of improving the coating properties of the material or for like purposes.

The image receiving material of the present invention comprises a water-soluble base and/or base precursor for simplification and expedition of processing and preservability. The addition layer thereof is not restricted, but it is preferred to be added to a dye-fixing layer in the image receiving material.

As mentioned in U.S. Pat. No. 4,740,445, the reaction of a compound (e.g., guanidium picolate) capable of complexing with metallic ions constituting a difficultly soluble metal salt compound (e.g., zinc oxide, basic zinc carbonate, calcium carbonate) in the presence of water as a medium with the difficultly soluble metal salt compound can be utilized to produce a water-soluble base. In accordance with this method, a light-sensitive material comprising a dispersion of the difficultly soluble metal salt compound incorporated therein and an image receiving material comprising as a base precursor a water-soluble compound capable of complexing with the metallic ions incorporated therein can be subjected to heat treatment while in close contact with each other in the presence of water to produce a base. Thus, this method is particularly effective with respect to storability.

Examples of the bases to be used in the present invention include inorganic bases such as hydroxide, carbonate, bicarbonate, secondary and tertiary phosphate of alkaline metals and quaternary alkylammonium, organic bases such as aliphatic amines, aromatic amines, heterocyclic amines, amidines, cyclic amidines, guanidines and cyclic guanidines, and carbonate, bicarbonate, and secondary and tertiary phosphates thereof.

As the base precursor to be used in the present invention there can be used a base precursor of the above mentioned organic bases. The base precursor undergoes thermal decomposition or electrolysis to release a basic component. Examples of such a base precursor include a salt of a thermally-decomposable organic acid such as trichloroacetic acid, cyanoacetic acid, acetoacetic acid and α-sulfonylacetic acid with the above mentioned organic base or 2-carboxycarboxamide as described in U.S. Pat. No. 4,088,496. In addition, the base precursors described in British Patent 998,945, U.S. Pat. No. 3,220,846, and JP-A-50-22625 can be used.

As the compound which undergoes electrolysis to produce a base there can be used the following methods. Typical examples of methods using electrolytic oxidation include the electrolysis of various aliphatic salts. In accordance with this reaction, carbonates of alkaline metals or organic bases such as guanidines and amidines can be extremely efficiently obtained. Examples of methods using electrolytic reduction include the production of amines by reduction of nitro and nitroso compounds, the production of amines by reduction of nitriles, and the production of p-aminophenols, p-phenylenediamines and hydrazines by reduction of nitro compounds, azo compounds, azoxy compounds, etc. p-Aminophenols, p-phenylenediamines and hydrazines may be used not only as bases but also directly as color image-forming substances. Also, the electrolysis of water in the presence of various inorganic salts to produce an alkaline component can be utilized.

These bases and/or base precursors may be used singly or in combination.

The amount of these bases and/or base precursors is normally in the range of $5\times10^{-4}$ to $5\times10^{-1}$ mole/m$^2$, preferably $2.5\times10^{-3}$ to $2.5\times10^{-2}$ mole/m$^2$.

The polymer dispersion to be incorporated into the dye fixing element of the present invention as an anticurling agent is preferably one in which the polymer constituting the dispersion exhibits a glass transition temperature of 25° C. or lower. Even if the glass transition temperature of the polymer is higher than 25° C., the polymer may be used in combination with an oily plasticizer to substantially exhibit the effects of a glass transition temperature of 25° C. or lower. In order to incorporate the plasticizer into the polymer dispersion, the plasticizer may be present in the system during synthesis. In general, the polymer dispersion may be stirred for a predetermined period of time in admixture with the plasticizer emulsion.

Examples of the polymer dispersion to be used in the present invention include latexes synthesized by an emulsion single polymerization or emulsion copolymerization of vinyl acetate, ethylene-vinyl acetate, acryl, vinylidene chloride, vinyl chloride, butadiene or butadiene derivatives, and polymer dispersions obtained by the emulsion dispersion of a solution of the above mentioned polymers, polyesters and polyurethanes or the like in an organic solvent. In particular, vinyl acetate, ethylene-vinyl acetate, acryl and styrene-butadiene dispersions are preferably used from the standpoint of fastness to light, thermal stability, diffusion stability of the coating solution, anticurling effect, inhibition of deposition of salts, etc.

Specific examples of polymer latexes to be incorporated into the dye fixing element of the present invention as curling property improvers will be given below, but the present invention should not be construed as being limited thereto.

Examples of commercially available latexes and emulsions include Nipol LX811, 814, 820, 821, 822, 823, 825, 826, 842, 851, 852, 854, 855, 857, 860, 874, 110, 112, 119, 139, 206, 209, 600, 415A, 426, 430, 432A, 433, 435, 436, 438C, 472, 473, 479, 511, 513, 517, 518, 531, 407F (produced by Nippon Zeon Co., Ltd.), Polysol (various latexes or emulsions of vinyl acetate, vinyl acetate-acryl, ester acrylate, vinyl acetate-VeoVa, styrene-acryl and ethylene-vinyl acetate commercially available from Showa High Polymer Co., Ltd.), and VONDIC 1040, 1050, 1310F, 1320NS, 1340, 1510, 1610NS, 1612NS, 1640, 1660, 1670 (N), 1930N, 1980 (produced by Dainippon Ink And Chemicals, Inc.).

The amount of the polymer latex to be added is defined as the proportion of the total volume of polymer in the latex incorporated into the layer to the total volume of the hydrophilic binder incorporated in the layer. It is preferably in the range of 5 to 300 vol.%, more preferably 10 to 200 vol.%. If this value falls below 5 vol.%, the effect of inhibiting crack is reduced. On the contrary, if this value exceeds 300 vol.%, it gives a reduced film strength, showing a tendency for glossiness to drop. As calculated in terms of coated amount, the amount of the polymer latex to be added is preferably in the range of 0.5 g/m$^2$ to 10 g/m$^2$, more preferably 1 g/m$^2$ to 5 g/m$^2$.

The polymer latex to be used in the present invention exerts a remarkable effect if a polymer mordant having a high glass transition temperature, particularly 25° C. or higher, is used.

The light-sensitive element to be used in combination with the dye fixing element of the present invention may be subjected to a wet processing in the vicinity of ordinary temperatures or it may be heat-developed. The latter type of a light-sensitive element is preferred because it produces more remarkable effects of the present invention when used in combination with the dye fixing element of the present invention.

The light-sensitive element comprises a light-sensitive silver halide, a dye providing compound (as mentioned below, a reducing agent may serve as a dye providing compound as well), and a binder provided on a support, and optionally an organic metal salt oxidizer. These components are often incorporated into the same layer, but may be separately incorporated into separate layers if they are in a reactive form. For example, a colored dye providing compound may be present in a layer under the silver halide emulsion to inhibit a drop in sensitivity. The reducing agent is preferably incorporated into the light-sensitive element, but may be externally supplied, e.g., by diffusion from the dye fixing element as described below.

In order to obtain a wide range of colors in the chromaticity diagram from the subtractive primaries, i.e., yellow, magenta and cyan, at least three silver halide emulsion layers having light-sensitivity in different spectral ranges are used in combination. For example, a combination of a blue-sensitive layer, a green-sensitive layer and a red-sensitive layer or a combination of a green-sensitive layer, a red-sensitive layer and an infrared-sensitive layer may be used. These light-sensitive layers may be arranged in various orders known in the field of ordinary type color light-sensitive materials. These light-sensitive layers may each be divided into two or more layers as necessary.

The heat developable light-sensitive material may be provided with various auxiliary layers such as protective layer, undercoating layer, interlayer, yellow filter layer, antihalation layer and back layer.

The silver halide to be used in the present invention may be any silver chloride, silver bromide, silver iodobromide, silver chlorobromide, silver chloroiodide and silver chloroiodidobromide.

The silver halide emulsion to be used in the present invention may be a surface latent image type emulsion or an internal latent image type emulsion. The internal latent image type emulsion may be used as a direct reversal emulsion when combined with a nucleating agent or light fogging agent. The silver halide emulsion to be used in the present invention may beta so-called core-shell emulsion differing from core to shell in phase. The silver halide emulsion may be monodisperse or polydisperse. Alternatively, monodisperse silver halide emulsions may be used in admixture. The grain size of silver halide grains is preferably in the range of 0.1 to 2 μm, particularly 0.2 to 1.5 μm. The crystal habit of silver halide grains may be cube, octahedron, tetradecahedron, tablet having a high aspect ratio, or other crystal forms.

Specifically, the silver halide emulsions disclosed in U.S. Pat. Nos. 4,500,626 (50th column), and 4,628,021, Research Disclosure (hereinafter referred to as "RD") No. 17029 (1978), and JP-A-62-253159 may be used.

The silver halide emulsion may be used unripened but is normally subjected to chemical sensitization before use. For example, an emulsion for the ordinary type light-sensitive material may be subjected to known sulfur, reduction, noble metal or selenium sensitization, singly or in combination. These chemical sensitization processes can be effected in the presence of a nitrogen-containing heterocyclic compound as described in JP-A-62-253159.

The coated amount of the light-sensitive silver halide emulsion to be used in the present invention is in the range of 1 mg/m$^2$ to 10 g/m$^2$ as calculated in terms of silver.

The silver halide emulsion to be used in the present invention may be subjected to spectral sensitization with a methine dye or the like. Examples of dyes to be used in the spectral sensitization include cyanine dye, merocyanine dye, composite cyanine dye, composite merocyanine dye, holopolar cyanine dye, hemicyanine dye, styryl dye and hemioxonol dye.

Specifically, the sensitizing dyes disclosed in U.S. Pat. No. 4,617,257, JP-A-59-180550, and JP-A-60-140335, and RD17029 (1978), pp. 12–13, can be used.

These sensitizing dyes can be used singly or in combination. A combination of these sensitizing dyes is often used, particularly for the purpose of supersensitization.

Besides these sensitizing dyes, a dye which does not exert a spectral sensitizing effect itself, or a compound which does not substantially absorb visible light but exerts a supersensitizing effect, may be incorporated into the emulsion (as disclosed in U.S. Pat. No. 3,615,641, and JP-A-63-23145).

The time at which these sensitizing dyes are incorporated into the emulsion may be during, before or after chemical ripening or may be before or after nucleation of the silver halide grains as disclosed in U.S. Pat. Nos. 4,183,756, and 4,225,666. The amount of these sensitizing dyes to be added is normally in the range of $10^{-8}$ mole to $10^{-2}$ mole per mole of silver halide.

If the dye fixing element of the present invention is used in a heat-developable system, the light-sensitive element may comprise an organic metal salt as an oxidizer in combination with the light-sensitive silver halide emulsion. Particularly preferred among these organic metal salts are organic silver salts.

Examples of organic compounds which can be used to form such an organic silver salt as an oxidizer include benzotriazoles and aliphatic acids as disclosed in U.S. Pat. No, 4,500,626, columns 52–53, and other compounds. Other useful examples of organic compounds include silver salts of carboxylic acids containing alkynyl group such as silver phenylpropiolate as described in JP-A-60-113235, and silver acetylene as described in JP-A-61-249044. Two or more of these organic silver salts may be used in combination.

The above mentioned organic silver salt can be used in an amount of 0.01 to 10 mole, preferably 0.01 to 1 mole, per mole of light-sensitive silver halide. The sum of the coated amount of light-sensitive silver halide and organic silver salt is preferably in the range of 50 mg/m$^2$ to 10 g/m$^2$ as calculated in terms of silver.

In the present invention, various fog inhibitors or photographic stabilizers can be used. Examples of such fog inhibitors or photographic stabilizers include the azoles and azaindenes disclosed in RD17643 (1978), pp. 24–25, the carboxylic acids and phosphoric acids containing nitrogen disclosed in JP-A-59-168442, the mercapto compounds and metallic salts thereof disclosed in JP-A-59-111636, and the acetylene compounds disclosed in JP-A-62-87957.

As the reducing agent to be used in the present invention there can be used one known in the field of light-sensitive materials. The reducing dye providing compounds described below can also be used (in this case, other reducing agents can be used in combination therewith). Further, a reducer precursor which exhibits no reducing effect itself, but exerts a reducing effect when acted upon by a nucleophilic reagent or heat during development can be used.

Examples of reducing agents which can be used in the present invention include the reducing agents and reducer precursors disclosed in U.S. Pat. Nos. 4,500,626 (columns 49–50), 4,483,914 (columns 30–31), 4,330,617, and 4,590,152, JP-A-60-140335, pp. 17–18, JP-A-57-40245, JP-A-56-138736, JP-A-59-178458, JP-A-59-53831, JP-A-59-182449, JP-A-59-182450, JP-A-60-119555, JP-A-60-128436, JP-A-60-128437, JP-A-60-128438, JP-A-60-128439, JP-A-60-198540, JP-A-60-181742, JP-A-61-259253, JP-A-62-244044, JP-A-62-131253, JP-A-62-131254, JP-A-62-131255, JP-A-62-131256, and European Patent 220,746A2, pp. 78–96.

A combination of the various reducing agents disclosed in U.S. Pat. No. 3,039,869 can be used.

When a nondiffusible reducing agent is used, an electron transfer agent and/or electron transfer agent precursor can be optionally used in combination therewith to accelerate the migration of electrons between the nondiffusible reducing agent and the developable silver halide.

Such an electron transfer agent or a precursor thereof can be selected from the above mentioned reducing agents or precursors thereof. The electron transfer agent or a precursor thereof preferably exhibits a greater mobility than the nondiffusible reducing agent (electron donor). Particularly useful electron transfer agents are 1-phenyl-3-pyrazolidones or aminophenols.

The nondiffusible reducing agent (electron donor) to be used in combination with the electron transfer agent can be a compound which substantially does not migrate in the layers constituting light-sensitive material among the above mentioned reducing agents. Preferred examples of such nondiffusible reducing agents include hydroquinones, sulfonamidephenols, sulfonamidenaphtholes, compounds described as electron donors in JP-A-3-110827, and nondiffusible reducing dye providing compounds as described below.

In the present invention, the amount of the reducing agent to be added is preferably in the range of 0.001 to 20 mole, particularly 0.01 to 10 mole, per mole of silver.

In the present invention, a compound which produces or releases a mobile dye in correspondence or counter correspondence to exposure, i.e., a dye providing compound, is used.

Examples of dye providing compounds which can be used in the present invention include compounds (couplers) which undergo an oxidative coupling reaction to form a dye. These couplers may be two-equivalent or four-equivalent. Further, two-equivalent couplers containing a nondiffusible group as a separable group which undergo an oxidative coupling reaction to form a diffusible dye can be preferably used. These nondiffusible groups may form a polymer chain. Specific examples of color developing agents and couplers are described in T. H. James, The Theory of the Photographic Process, 4th ed., pp. 291–334 and pp. 354–361, and JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474, and JP-A-60-66249.

Another example of the dye providing compound is a compound which serves to imagewise release or diffuse a diffusive dye. This type of a compound can be represented by the following general formula [LI]:

$$(\text{Dye}-\text{Y})\text{n}-\text{Z} \qquad [\text{LI}]$$

wherein Dye represents a dye group, or a dye group or dye precursor group which has been temporarily shifted to a short wavelength; Y represents a simple bond or linking group; Z represents a group which makes a difference in the diffusibility of the compound represented by (Dye-Y)n-Z or releases Dye to make a difference in the diffusibility from (Dye-Y)n-Z in correspondence or counter correspondence to a light-sensitive silver salt having an imagewise latent image; and n represents an integer 1 or 2, with the proviso that when n is 2, the two (Dye-Y) groups may be the same or different.

Specific examples of the dye providing compound represented by general formula [LI] include the following compounds (1) to (5). Compounds (1) to (3) form a diffusive dye image (positive dye image) in counter correspondence to the development of silver halide. Compounds (4) and (5) form a diffusive dye image (negative dye image) in correspondence to the development of silver halide.

(1) Dye developing agents in which a hydroquinone developing agent and a dye component are connected to each other as disclosed in U.S. Pat. Nos. 3,134,764, 3,362,819, 3,597,200, 3,544,545, and 3,482,972. These dye developing agents are diffusible under alkaline conditions, but react with silver halide to become nondiffusible.

(2) As described in U.S. Pat. No. 4,503,137, nondiffusible compounds can be used which release a diffusible dye under alkaline conditions, but lose its capability when reacted with silver halide. Examples of such nondiffusible compounds include compounds which undergo an intramolecular nucleophilic substitution reaction to release a diffusible dye as disclosed in U.S. Pat. No. 3,980,479, and compounds which undergo an intramolecular rearrangement reaction of isooxazolone rings to release a diffusible dye as disclosed in U.S. Pat. No. 4,199,354.

(3) As disclosed in U.S. Pat. Nos. 4,559,290, and 4,783,396, European Patent 220,746A2, and Japanese Published Technical Report (Kokai Giho) 87-6199, nondiffusible compounds can be used which react with a reducing agent left unoxidized upon development to release a diffusible dye.

Examples of such nondiffusible compounds include compounds which undergo an intramolecular nucleophilic substitution reaction after reduction to release a diffusible dye as described in U.S. Pat. Nos. 4,139,389, and 4,139,379, and JP-A-59-185333, and JP-A-57-84453, compounds which undergo an intramolecular electron migration reaction after reduction to release a diffusible dye as described in U.S. Pat. No. 4,232,107, JP-A-59-101649, and JP-A-61-88257, and RD24025 ( 1984 ) , compounds which undergo cleavage of a single bond after reduction to release a diffusible dye as described in West German Patent 3,008,588A, JP-A-56-142530, and U.S. Pat. Nos. 4,343,893, and 4,619,884, nitro compounds which release a diffusible dye after receiving electrons as described in U.S. Pat. No. 4,450,223, and compounds which release a diffusible dye after receiving electrons as described in U.S. Pat. No. 4,609,610.

Preferred examples of such nondiffusible compounds include compounds containing N-X bond ( in which X represents oxygen, sulfur or nitrogen atom) and an electrophilic group per molecule as disclosed in European Patent 220,746A2, Japanese Published Technical Report (Kokai Giho) 87-6199, U.S. Pat. No. 4,783,396, and JP-A-63-201653, and JP-A-63-201654, compounds containing $SO_2-X$ bond ( in which X is as defined above ) and an electrophilic group per molecule as disclosed in JP-A-1-26842, and compounds containing C-X' bond (in which X' has the same meaning as X or represents $-SO_2-$) and an electrophilic group per molecule as disclosed in JP-A-63-271341. Compounds which undergo cleavage of a single bond after reduction by a $\pi$ bond conjugated with an electron accepting group to release a diffusible dye as disclosed in JP-A-1-161237 and JP-A-1-161342 can also be used.

Particularly preferred among these compounds are compounds containing N-X bond and an electrophilic group per molecule. Specific examples of these compounds include Compounds (1) to (3), (7) to (10), (12), (13), (15), (23) to (26), (31), (32), (35), (36), (40), (41), (44), (53) to (59), (64) and (70) in European Patent 220,746A2 or U.S. Pat. No. 4,783,396, and Compounds (11) to (23) in Japanese Published Technical Report (Kokai Giho) 87-6199.

(4) Coupler compounds containing a diffusible dye as a separable group which undergo a reaction with an oxidation product of a reducing agent to release a diffusible dye (DDR couplers). Specific examples of such DDR couplers are described in British Patent 1,330,524, JP-B-48-39165, and U.S. Pat. Nos. 3,443,940, 4,474,867, and 4,483,914.

(5) Compounds which are capable of reducing silver halides or organic silver salts and release a diffusible dye when reducing the silver halides or organic silver salts (DRR compounds). These compounds do not require the use of other reducing agents, eliminating the stain on the image with an oxidative decomposition product of reducing agents. Typical examples of such DRR compounds are described in U.S. Pat. Nos. 3,928,312, 4,053,312, 4,055,428, 4,336,322, 3,725,062, 3,728,113, 3,443,939, and 4,500,626, JP-A-59-65839, JP-A-59-69839, JP-A-53-3819, JP-A-51-104343, JP-A-58-116537, and JP-A-57-179840, and RD17465. Specific examples of these. DRR compounds include the compounds disclosed in U.S. Pat. No. 4,500,626, columns 22–44. Particularly preferred among these compounds are Compounds (1) to (3), (10) to (13), (16) to (19), (28) to (30), (33) to (35), (38) to ( 40 ) , and ( 42 ) to ( 64 ) . Further, the compounds described in U.S. Pat. No. 4,639,408, columns 37–39, are useful.

As the dye providing compounds other than the above mentioned couplers and the dye providing compounds represented by general formula [LI], there can be used dye silver compounds in which an organic silver salt and a dye are connected to each other (Research Disclosure, May 1978, pp. 54–58), azo dyes for use in heat development silver dye bleaching processes (U.S. Pat. No. 4,235,957, Research Disclosure, April 1976, pp. 30–32), and leuco dyes (U.S. Pat. Nos. 3,985,565, and 4,022,617).

The incorporation of a hydrophobic additive such as dye providing compound and a nondiffusible reducing agent in the layers constituting the light-sensitive material can be accomplished by any known method. In this case, a high boiling organic solvent as disclosed in JP-A-59-83154, JP-A-59-178451, JP-A-59-178452, JP-A-59-178453, JP-A-59-178454, JP-A-59-178455, and JP-A-59-178457 can be used in combination with an organic solvent having a boiling point as low as 50° C. to 160° C., as necessary.

The amount of the high boiling organic solvent to be used is in the range of 10 g or less, preferably 5 g or less, per g of dye providing compound used or 1 cc or less, more preferably 0.5 cc or less, particularly 0.3 cc or less, per g of binder used.

Alternatively, a dispersion process with a polymer as described in JP-B-51-39853 (the term "JP-B" as used herein means an "examined Japanese patent publication") and JP-A-51-59943 can be used.

A compound substantially insoluble in water can be finely dispersed in the binder rather than using the above mentioned methods.

When a hydrophobic compound is dispersed in a hydrophilic colloid, various surface active agents can be used. For example, the compounds disclosed as surface active agents in JP-A-59-157636, pp. 37–38 can be used.

In the present invention, a compound which not only activates development, but also stabilizes an image, may be incorporated into the light-sensitive material. Specific examples of such compounds which can be preferably used are described in U.S. Pat. No. 4,500,626, columns 51–52.

As the binder to be incorporated into the layers constituting the light-sensitive material and the dye fixing material, there may be preferably used a hydrophilic binder. Examples of such a hydrophilic binder include those described in JP-A-62-253159, pp. 26–28. In particular, a transparent or semitransparent hydrophilic binder is preferred. Examples of such a transparent or semitransparent hydrophilic binder include natural compounds such as protein, e.g., gelatin and gelatin derivative or cellulose derivatives and polysaccharides, e.g., starch, gum arabic, dextran and pullulan, polyvinyl alcohol, polyvinyl pyrrolidone, acrylamide polymer, and other synthetic high molecular compounds. Further, the high water absorption polymer disclosed in JP-A-62-245260, i.e., a single polymer of vinyl monomer containing —COOM or —$SO_3M$ (in which M represents a hydrogen atom or alkaline metal ) or a copolymer of vinyl monomers or with other vinyl monomers (e.g., sodium methacrylate, ammonium methacrylate, Sumikagel L-5H produced by Sumitomo Chemical Company, Limited) can be used. Two or more of these binders may be used in combination.

When a system is employed, in which heat development is effected with a slight amount of water being supplied, the above mentioned high water absorption polymer can be used to expedite the absorption of water. Further, such a high water absorption polymer can be incorporated into the dye fixing layer or its protective layer to prevent the transferred dye from being retransferred from the dye fixing material to other materials.

In the present invention, the coated amount of binder is preferably in the range of 20 g or less, more preferably 10 g or less, particularly 7 g or less, per $m^2$ of the material.

Examples of the film hardeners to be incorporated into the layers constituting the light-sensitive material or dye fixing material include those described in U.S. Pat. No. 4,678,739, and JP-A-59-116655, JP-A-62-245261, and JP-A-61-18942. Specific examples of such film hardeners include aldehyde film hardeners (e.g., formaldehyde), aziridine film hardeners, epoxy film hardeners, vinylsulfone film hardeners (e.g., N,N'-ethylene-bis(vinylsulfonylacetamide)ethane), N-methylol film hardeners (e.g., dimethylolurea), and high molecular film hardeners (e.g., compounds described in JP-A-62-234157).

Particularly preferred among these film hardeners are epoxy film hardeners from the standpoint of coating properties (e.g., age stability of the coating solution in the form of a solution and reactivity of the coating solution with adjacent layers after coating), film quality (e.g., age stability and curing properties of a fresh specimen) and photographic properties (e.g., transfer density). Specific examples of such epoxy film hardeners include the film hardeners disclosed in JP-A-62-91942.

In the present invention, the light-sensitive material and/or dye fixing material can comprise an image formation accelerator. Such an image formation accelerator serves to accelerate the redox reaction of a silver salt oxidizer and a reducing agent, accelerate reactions such as production or decomposition of a dye from a dye providing substance and release of a diffusible dye from a dye providing substance, or accelerate the migration of a dye from the light-sensitive material layer to the dye fixing layer. From the standpoint of physicochemical function, the image formation accelerator can be classified as a base or base precursor, a nucleophilic compound, a high boiling organic solvent (oil), a heat solvent, a surface active agent, a compound interacting with silver or silver ion, etc. However, these substances normally have composite functions and exert some of these accelerating effects in combination. These image formation accelerators are further described in U.S. Pat. No. 4,678,739, columns 38–40.

In the present invention, the light-sensitive material and/or dye fixing material may comprise various development stop agents for the purpose of obtaining an invariably constant image quality against the fluctuation of processing temperature and time during development.

The development stop agent is a compound which rapidly neutralizes or reacts with a base after proper development to reduce the base concentration in the film to stop development or a compound which interacts with silver or a silver salt after proper development to inhibit develoment. Specific examples of such a development stop agent include an acid precursor which releases an acid under heating, an electrophilic compound which undergoes a substitution reaction with a base present therewith under heating, a nitrogen-containing heterocyclic compound, and a mercapto compound and precursor thereof. These compounds are further described in JP-A-62-253159, pp. 31–32.

The layers (including back layer) constituting the light-sensitive material or dye fixing material may comprise various polymer latexes for the purpose of improving the film properties, e.g., stabilizing dimension and inhibiting curling, adhesion, film crack and pressure sensitization or desensitization. Specifically, any of the polymer latexes disclosed in JP-A-62-45258, JP-A-62-136648, and JP-A-62-110066 can be used. In particular, a polymer latex having glass transition point as low as 40° C. or even lower can be incorporated into the mordant layer to inhibit cracking of the mordant layer. Further, a polymer latex having a high glass transition point can be incorporated into the back layer to provide an anticurling effect.

The layers constituting the light-sensitive material and the dye fixing material can comprise a plasticizer, a lubricant or a high boiling organic solvent, as an agent for improving the peelability between the light-sensitive material and the dye fixing material. Specific examples of these agents include those described in JP-A-62-253159, page 25, and JP-A-62-245253.

Further, for the above mentioned purposes, various silicone oils (ranging from dimethyl silicone oil to modified silicone oils obtained by incorporating various organic groups in dimethyl siloxane) can be used. Useful examples of such silicone oils are various modified silicone oils described in "Modified Silicone Oil" (technical report published by Shin-Etsu Silicone Co., Ltd.), page 6–18B, particularly carboxy-modified silicone (trade name: X-22-3710).

Further, the silicone oils disclosed in JP-A-62-215953 and JP-A-63-46449 can also be effectively used.

The light-sensitive material or dye fixing material may comprise a discoloration inhibitor. Examples of such a discoloration inhibitor include an oxidation inhibitor, an ultraviolet absorbent, and various metal complexes.

Examples of such an oxidation inhibitor include chroman compounds, coumaran compounds, phenol compounds (e.g., hindered phenols), hydroquinone derivatives, hindered amine derivatives, and spiroindan compounds. Further, the compounds described in JP-A-61-159644 can also be effectively used as oxidation inhibitors.

Examples of ultraviolet absorbents to be used as discoloration inhibitors include the benzotriazole compounds disclosed in U.S. Pat. No. 3,533,794, the 4-thiazolidone compounds disclosed in U.S. Pat. No. 3,352,681, the benzophenone compounds disclosed in JP-A-46-2784, and the compounds disclosed in JP-A-54-48535, JP-A-62-136641, and JP-A-61--88256. Further, ultraviolet-absorbing polymers as disclosed in JP-A-62-260152 can also be effectively used as ultraviolet absorbents.

Examples of metal complexes to be used as discoloration inhibitors include the compounds disclosed U.S. Pat. Nos. 4,241,155, 4,245,018, columns 3–36, and 4,254,195, columns 3–8, and JP-A-62-174741, JP-A-61-88256, pp. 27–29, JP-A-63-199248, JP-A-1-75568, and JP-A-1-742.72.

Useful examples of such discoloration inhibitors are disclosed in JP-A-62-215272, pp. 125–137.

The discoloration inhibitor for inhibiting the transfer of a dye which has been transferred to the dye fixing material may be previously incorporated into the dye fixing material or supplied into the dye fixing material externally, e.g., from the light-sensitive material.

The above mentioned oxidation inhibitors, ultraviolet absorbents and metal complexes may be used in combination.

The light-sensitive material or dye fixing material may comprise a fluorescent brightening agent. In particular, such a fluorescent brightening agent is preferably incorporated into the dye fixing material or supplied into the dye fixing material externally, e.g., from the light-sensitive material. Examples of such a fluorescent brightening agent include the compounds disclosed in K. Veenkataraman, *The Chemistry of Synthetic Dyes,* vol. V, Chapter 8, and JP-A-61-143752. Specific examples of such a fluorescent brightening agent include stilbene compounds, coumarine compounds, biphenyl compounds, benzoxazolyl compounds, naphthal-imide compounds, pyrazoline compounds, and carbostyryl compounds.

Such a fluorescent brightening agent can be used in combination with a discoloration inhibitor.

The layers constituting the light-sensitive material or dye fixing material can comprise various surface active agents for the purpose of aiding coating, improving peelability and slip properties, inhibiting electrification, accelerating development or like purposes. Specific examples of such surface active agents are described in JP-A-62-173463, and JP-A-62-183457.

The light-sensitive material or dye fixing material can comprise a matting agent. Examples of such a matting agent include silicon dioxide, polyolefin and polymethacrylate as described in JP-A-61-88256, and the benzoguanamine resin beads, polycarbonate resin beads and AS resin beads described in JP-A-63-274944, and JP-A-63-274952.

In addition, the layers constituting the light-sensitive material and dye fixing material may comprise a heat solvent, an anti-foaming agent, a bacteriacide, a mildewproofing agent, a colloidal silica, etc. These additives are further described in JP-A-61-88256, pp. 26–32.

In the present invention, as the support for the light-sensitive material and dye fixing material there can be used any support material which can withstand the processing temperature. In general, paper and synthetic high molecular compounds (film) are used. Examples of such support materials include polyethylene terephthalate, polycarbonate, polyvinyl chloride, polystyrene, polypropylene, polyimide, cellulose (e.g., triacetyl cellulose), support materials obtained by incorporating a pigment such as titanium oxide in these films, paper obtained by film process synthesis of polypropylene, mixed paper made from a synthetic resin pulp such as polyethylene and a natural pulp, Yankee paper, baryta paper, coated paper (particularly cast coat paper), metal, cloth, and glass.

These support materials can be used directly or in the form of a laminate with a synthetic high molecular compound such as polyethylene on one or both sides thereof.

Besides these support materials, the support materials disclosed in JP-A-62-253159, pp. 29–31, can be used.

Onto the surface of these support materials may be coated a hydrophilic binder, an oxide of semiconducting metal such as alumina sol and tin oxide, carbon black, and other antistatic agents.

Examples of methods for imagewise exposing the light-sensitive material to record an image thereon include a method which comprises directly photographing a scene or persons using a camera or the like, a method which comprises exposure through a reversal film or negative film using a printer or enlarger, a method which comprises scanning exposure of an orginal image through a slit using an exposing apparatus in a copying machine, a method which comprises exposure to light emitted by a light emitting diode or various lasers excited by an electrical signal representative of image data, and a method which comprises direct exposure or exposure through an optical system of image data outputted to an image display apparatus such as CRT, liquid crystal display, electroluminescence display and plasma display.

Examples of light sources to be used in recording an image on the light-sensitive material include natural light, tungsten lamp, light emitting diode, laser, CRT, and other light sources as described in U.S. Pat. No. 4,500,626, column 56.

Further, a wavelength conversion element in which a nonlinear optical material is combined with a coherent light source such as laser can be used to effect imagewise exposure. The nonlinear optical material is a material capable of developing nonlinearity between polarization and electric fields created when a strong photoelectric field such as laser is given. Inorganic compounds such as lithium niobate, potassium dihydrogenphosphate (KDP), lithium iodate and $BaB_2O_4$, urea derivatives, nitroaniline derivatives, nitropyridine-N-oxide derivatives such as 3-methyl-4-nitropyridine-N-oxide (POM), and the compounds described in JP-A-61-53462 and JP-A-62-210432 are preferably used. As wavelength conversion elements there are known single crystal light guide type wavelength conversion elements, fiber type wavelength conversion elements, etc. Any of these types of wavelength conversion elements can be effectively used.

Examples of the image data which can be used include an image signal obtained from a video camera, an electronic still camera, etc., a television signal stipulated by National Television Signal Code (NTSC), an image signal obtained by dividing an orginal image into many pixels by a scanner, and an image signal produced by compueters such as CG and CAD.

The heating temperature at the heat development process depends on the film pH to be adjusted with a base or base precursor. Heat development can be effected at a heating temperature of about 25° C. to about 250° C., preferably 50° C. to 200° C., particularly about 70° C. to about 180° C. The diffusion transfer of a dye may be effected at the same time as or after the heat development process. In the latter case, the transfer of a dye can be effected at a heating temperature ranging from the heat development temperature to room temperature, particularly preferably, 50° C. to a temperature about 10° C. lower than the heat development temperature.

The migration of a dye can be effected by heat alone. In order to accelerate the migration of a dye, a solvent may be used. As described in detail in JP-A-59-218443 and JP-A-61-238056, the system is preferably heated in the presence of a small amount of a solvent (particularly water) to simultaneously or continuously effect development and transfer. In this process, the heating temperature is preferably from 50° C. to a temperature lower than the boiling point of the solvent, e.g., 100° C. or lower if the solvent is water.

Examples of solvents to be used in the acceleration of development and/or the transfer of a diffusible dye to the dye fixing layer include water and a basic aqueous solution containing an inorganic alkaline metal salt or organic base (these bases include those described with reference to the image formation accelerator). Further, a low boiling solvent, and a mixture of a low boiling solvent and water or a basic aqueous solution, may be used. Moreover, a surface active agent, a fog inhibitor, a difficultly soluble metal salt, a complexing compound, etc., may be contained in these solvents.

These solvents may be provided to either or both of the dye fixing material and the light-sensitive material. The amount of these solvents to be used may be not more than the weight thereof corresponding to the maximum swellable volume of the coated film (particularly the weight thereof corresponding to the maximum swellable volume of the coated film minus the weight of the coated film).

In order to provide these solvents to the light-sensitive layer or dye fixing layer, a method such as disclosed in JP-A-61-147244, page 26, can be used. Alternatively, these solvents may be previously included in either or both of the light-sensitive material and the dye fixing material in the form of microcapsules.

In order to accelerate the migration of a dye, a hydrophilic heat solvent which stays solid at normal temperature, but becomes soluble at an elevated temperature, may be incorporated into the light-sensitive material or dye fixing material. Such a hydrophilic heat solvent may be incorporated into either or both of the light-sensitive material and the dye fixing material. The layer into which the hydrophilic heat solvent is incorporated may be an emulsion layer, an interlayer, a protective layer or a dye fixing layer, preferably a dye fixing layer and/or its adjacent layers.

Examples of such a hydrophilic heat solvent include ureas, pyridines, amides, sulfonamides, imides, a alcohols, oximes, and other heterocyclic groups.

In order to accelerate the migration of a dye, a high boiling organic solvent may be incorporated into the light-sensitive material and/or dye fixing material.

Examples of the heating means in the development and/or transfer process include a method which comprises bringing the material into contact with a heated block or plate, a hot plate, a hot presser, a heat roller, a halogen lamp heater, an infrared lamp heater, a far infrared lamp heater, etc., and a method which comprises passing the material through a high temperature atmosphere. Alternatively, the light-sensitive material or dye fixing material may be provided with a resistance heating element that is electrified to heat the material. The heating material layer can be one described in JP-A-61-145544.

In the image-fixing system of the present invention, a light-sensitive element and a dye fixing element are in planar contact with each other.

As pressure conditions and pressure application methods by which the light-sensitive material and the dye fixing material are laminated and adhered to each other, the conditions and methods described in JP-A-61-147244, page 27 can be used.

Processing the photographic elements of the present invention can be accomplished by means of any of various heat development apparatuses. For example, the apparatuses described in JP-A-59-75247, JP-A-59-177547, JP-A-59-181353, and JP-A-60-18951, and JP-A-U-59--25944 (the term "JP-A-U" as used herein means an "unexamined published Japanese utility model application") may be preferably used.

The present invention will be further described in the following examples, but the present invention should not be construed as being limited thereto.

EXAMPLE 1

A light-sensitive material was prepared from the components as set forth in Table 1 as light-sensitive material Specimen 101.

Light-Sensitive Silver Halide Emulsion (for Red-Sensitive Emulsion Layer)

Solution (I) and Solution (II) set forth in Table A were simultaneously added dropwise to an aqueous solution of gelatin (obtained by adding 20 g of gelatin, 0.3 g of potassium bromide, 6 g of sodium chloride and 30 mg of the following chemical A to 800 cc of water and heating the mixture to a temperature of 50° C.) which had been thoroughly stirred at the same flow rate for 30 minutes. Solutions (III) and (IV) mentioned below were then simultaneously added to the system for 30 minutes. When 3 minutes had passed from the beginning of the addition of Solutions (III) and (IV), a mixture of 67 mg of the following Sensitizing Dye (a) and 133 mg of the following Sensitizing Dye (b) was added to the system.

After the emulsion was rinsed and desalted, 22 g of lime-treated osein gelatin was added to the emulsion to adjust the pH and pAg values to 6.2 and 7.7, respectively. The emulsion was then subjected to optimum chemical sensitization with sodium thiosulfate, 4-hydroxy-6-methyl-1,3,3a,7-tetrazaindene and chloroauric acid at a temperature of 60° C. Thus, a monodisperse emulsion of cubic silver chlorobromide grains having an average grain size of 0.38 μm was obtained. The yield was 635 g.

TABLE A

| | Solution (I) | Solution (II) | Solution (III) | Solution (IV) |
|---|---|---|---|---|
| $AgNO_3$ | 50.0 g | — | 50.0 g | — |
| KBr | — | 28.0 g | — | 35.0 g |
| NaCl | — | 3.4 g | — | — |
| Water to make | 200 cc | 200 cc | 200 cc | 200 cc |

Chemical A

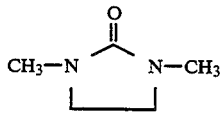

Sensitizing Dye (a)

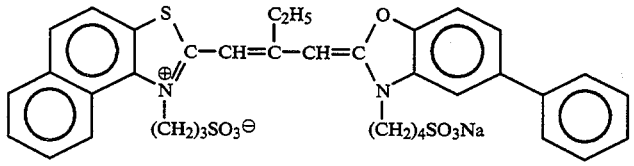

Sensitizing Dye (b)

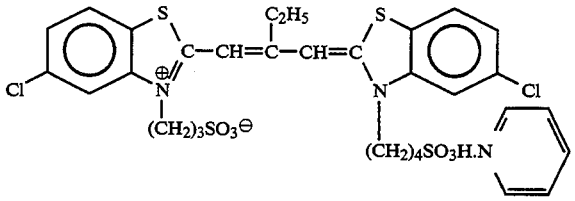

Light-Sensitive Silver Halide Emulsion (for Green-Sensitive Emulsion Layer)

Solution (I) and Solution (II) set forth in Table B were simultaneously added dropwise to an aqueous solution of gelatin (obtained by adding 20 g of gelatin, 0.3 g of potassium bromide, 6 g of sodium chloride and 15 mg of the chemical A to 730 cc of water and heating the mixture to a temperature of 60° C.) which had been thoroughly stirred for 30 minutes. Solutions (III) and (IV) mentioned below were then simultaneously added to the system for 30 minutes. When 1 minute had passed from the completion of the addition of Solutions (III) and (IV), 230 mg of the following Sensitizing Dye (c) was added to the system.

After the emulsion was rinsed and desalted, 20 g of gelatin was added to the emulsion to adjust the pH and pAg values to proper values. The emulsion was then subjected to optimum chemical sensitization with triethylthiourea, chloroauric acid, and 4-hydroxy-6-methyl-1,3,3a,7- tetrazaindene.

Thus, a monodisperse emulsion of cubic silver chlorobromide grains having an average grain size of 0.4 μm was obtained. The yield was 630 g.

TABLE B

| | Solution (I) | Solution (II) | Solution (III) | Solution (IV) |
|---|---|---|---|---|
| $AgNO_3$ | 50.0 g | — | 50.0 g | — |
| KBr | — | 21.0 g | — | 28.0 g |
| NaCl | — | 6.9 g | — | 3.5 g |
| Water to make | 200 cc | 200 cc | 200 cc | 200 cc |

Sensitizing Dye (c)

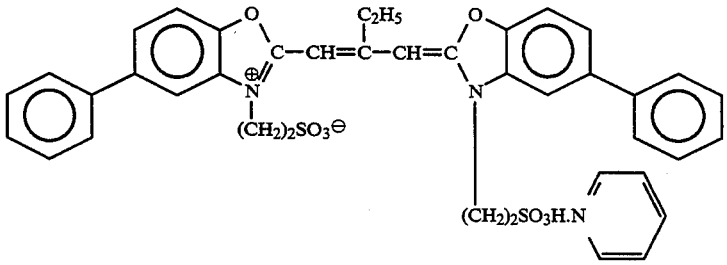

Light-Sensitive Silver Halide Emulsion (for Blue-Sensitive Emulsion Layer)

Solution (I) and Solution (II) set forth in Table C were simultaneously added to an aqueous solution of gelatin (obtained by adding 20 g of gelatin, 3 g of potassium bromide, 30 mg of the chemical A and 0.25 g of $HO(CH_2)_2S(CH_2)_2S(CH_2)_2OH$ to 800 cc of water and heating the mixture to a temperature of 50° C.) which had been thoroughly stirred for 30 minutes. Solutions (III) and (IV) mentioned below were then simultaneously added to the system for 20 minutes. When 5 minutes had passed from the completion of the addition of Solution (III), a solution of 180 mg of the following Sensitizing Dye (d) and 60 mg of the following .Sensitizing Dye (e) was added to the system.

After the emulsionwas rinsed and desalted, 20 g of lime-treated osein gelatin was added to the emulsion to adjust the pH and pAg values to 6.2 and 8.5, respectively. The emulsion was then subjected to optimum chemical sensitization with sodium thiosulfate, 4-hydroxy-6-methyl-1,3,3a,7-tetrazaindene and chloroauric acid. Thus, 600 g of a monodisperse emulsion of tetradecahedral silver chlorobromide grains having an average grain size of 0.40 μm was obtained.

TABLE C

| | Solution (I) | Solution (II) | Solution (III) | Solution (IV) |
|---|---|---|---|---|
| $AgNO_3$ | 30.0 g | — | 70.0 g | — |
| KBr | — | 17.8 g | — | 49.0 g |
| NaCl | — | 1.6 g | — | — |
| Water to make | 180 ml | 180 ml | 350 ml | 350 ml |

Sensitizing Dye (d)

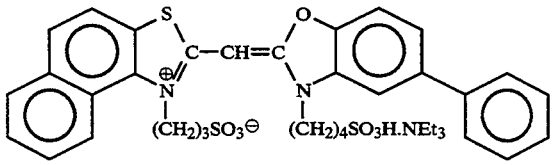

TABLE C-continued

| | Solution (I) | Solution (II) | Solution (III) | Solution (IV) |
|---|---|---|---|---|
| Sensitizing Dye (e) | | | | |

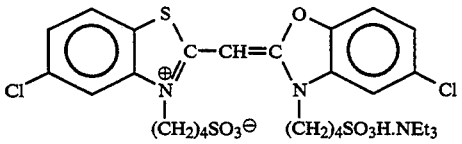

The preparation of a zinc hydroxide dispersion will be hereinafter described.

12.5 g of zinc hydroxide having an average grain size of 0.2 μm, 1 g of carboxymethyl cellulose as a dispersant, and 0.1 g of sodium polyacrylate were added to 100 cc of a 4% aqueous solution of gelatin. The material was then crushed with glass beads having an average grain diameter of 0.75 mm by means of a mill for 30 minutes. The glass beads were then removed to obtain a zinc hydroxide dispersion.

The preparation of an activated carbon dispersion will be hereinafter described.

2.5 g of an activated carbon powder (reagent, special grade) produced by Wako Pure Chemical Industries, Ltd., 1 g of Demol N produced by Kao Corporation as a dispersant, and 0.25 g of polyethylene glycol nonyl phenyl ether were added to 100 cc of a 5% aqueous solution of gelatin. The material was then crushed with glass beads having an average grain diameter of 0.75 mm by means of a mill for 120 minutes. The glass beads were then removed to obtain a dispersion of activated carbon grains having an average grain diameter of 0.5 μm.

The preparation of an electron transfer agent dispersion will be hereinafter described.

10 g of the following Electron Transfer Agent (*10), 0.5 g of polyethylene glycol nonyl phenyl ether as a dispersant, and 0.5 g of the following anionic surface active agent were added to a 5% aqueous solution of gelatin. The material was then crushed with glass beads having an average grain diameter of 0.75 mm by means of a mill for 60 minutes. The glass beads were then removed to obtain a dispersion of electron transfer agent grains having an average grain diameter of 0.4 μm.

Electron Transfer Agent (*10)

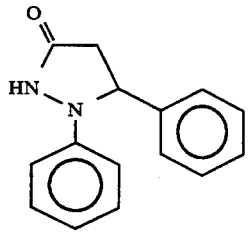

Anionic surface active agent

-continued $$NaO_3S-\underset{}{\overset{CH_2COOCH_2CH(C_2H_5)C_4H_9}{\overset{|}{C}}}HCOOCH_2CH(C_2H_5)C_4H_9$$

The preparation of a gelatin dispersion of a dye providing compound will be hereinafter described.

Components for yellow, magenta and cyan dye providing compounds were measured out in accordance with the formulation set forth in Table D. These components were heated at a temperature of about 60° C. to make uniform solutions. These solutions were each mixed with 100 g of a 10% aqueous solution of lime-treated gelatin, 0.6 g of sodium dodecylbenzenesulfonate and 50 cc of water with stirring. The mixtures were each subjected to dispersion at 10,000 rpm by means of a homogenizer for 10 minutes. These dispersions were gelatin dispersions of yellow, magenta and cyan providing compounds, respectively.

TABLE D

| | Yellow | Magenta | Cyan |
|---|---|---|---|
| Dye providing compounds shown below | (1) 13.0 g | (2) 15.5 g | (3) 16.6 g |
| Electron Donor (*1) shown below | 10.2 g | 8.6 g | 8.1 g |
| High Boiling Solvent (*2) shown below | 6.5 g | 7.8 g | 8.3 g |
| Electron Transfer Agent Precursor (*3) shown below | 0.4 g | 0.7 g | 0.7 g |
| $CO_2C_{12}H_{25}$ \| $CO_2C_{12}H_{25}$ | 3.9 g | — | — |
| Ethyl acetate | 50 cc | 50 cc | 50 cc |

(1) Yellow dye providing compound

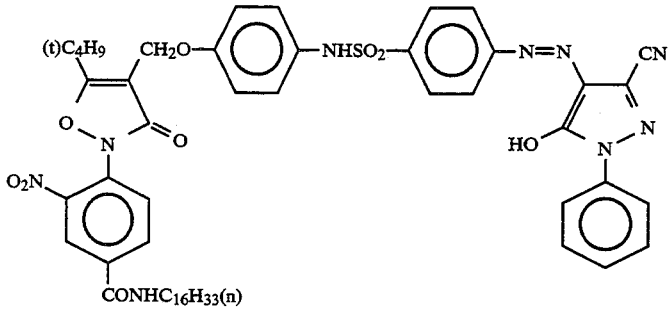

(2) Magenta dye providing compound

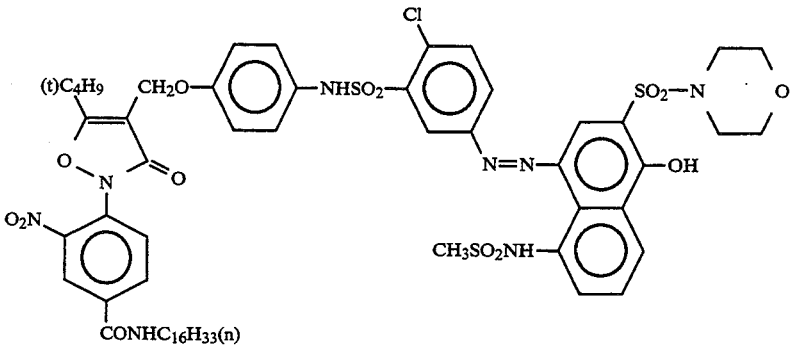

(3) Cyan dye providing compound

TABLE D-continued

| | Yellow | Magenta | Cyan |
|---|---|---|---|

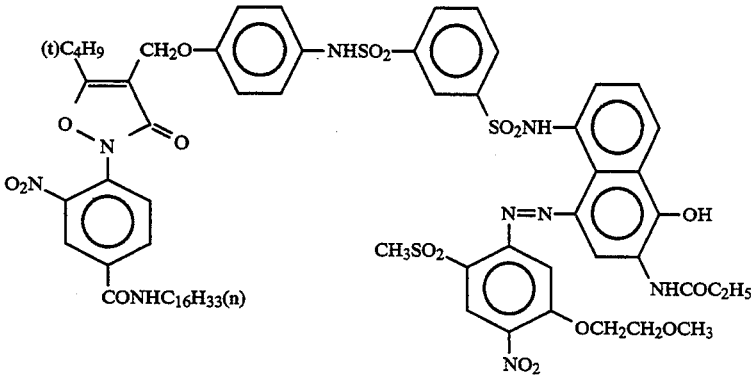

Electron Donor (*1)

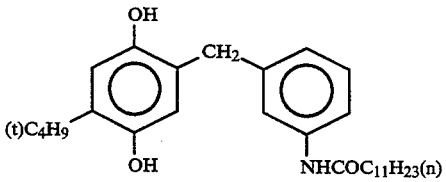

High Boiling Solvent (*2)

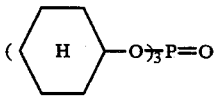

Electron Transfer Agent Precursor (*3)

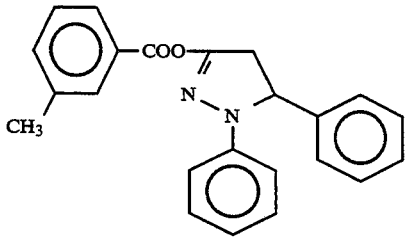

The preparation of a gelatin dispersion of Electron Donon (*4) for interlayer will be hereinafter described.

23.6 g of the following Electron Donon (*4) and 8.5 g of the above mentioned high boiling solvent were added to 30 cc of ethyl acetate. The mixture was then dissolved at a temperature of 60° C. to make a uniform solution. This solution was mixed with 100 g of a 10% aqueous solution of lime-treated gelatin, 0.25 g of hydrogen sulfite, 0.3 g of sodium dodecylbenzenesulfonate and 30 cc of water with stirring. The mixture was then subjected to dispersion at 10,000 rpm for 10 minutes by means of a homogenizer. This dispersion was a gelatin dispersion of Electron Donon (*4)

TABLE 1

Electron Donor (*4)

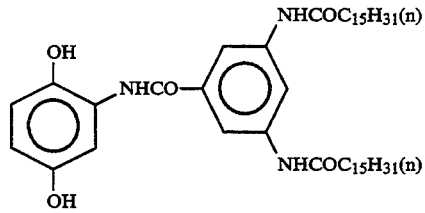

Constitution of light-sensitive Specimen 101

| Layer No. | Layer name | Formulation | Coated amount (mg/m$^2$) |
|---|---|---|---|
| 6th layer | Protective layer | Gelatin | 900 |
| | | Silica (size: 4 μm) | 40 |
| | | Zinc hydroxide | 900 |
| | | Surface Active Agent (*5) | 130 |
| | | Surface Active Agent (*6) | 26 |
| | | Polyvinyl alcohol | 63 |
| | | Lactose | 155 |
| | | Water-Soluble Polymer (*13) | 8 |

TABLE 1-continued

Electron Donor (*4)

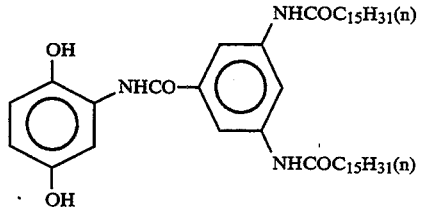

Constitution of light-sensitive Specimen 101

| Layer No. | Layer name | Formulation | Coated amount (mg/m²) |
|---|---|---|---|
| 5th layer | Blue-sensitive emulsion layer | Blue-sensitive silver halide emulsion | 380 in terms of silver |
| | | Fog Inhibitor (*7) | 0.9 |
| | | Gelatin | 560 |
| | | Yellow dye providing compound (1) | 400 |
| | | Electron Donor (*1) | 320 |
| | | Electron Transfer Agent Precursor (*3) | 25 |
| | | High Boiling Solvent (*2) | 200 |
| | | Surface Active Agent (*8) | 45 |
| | | Water-Soluble Polymer (*13) | 13 |
| 4th layer | Interlayer | Gelatin | 555 |
| | | Electron Donor (*4) | 130 |
| | | High Boiling Solvent (*2) | 48 |
| | | Electron Transfer Agent (*10) | 85 |
| | | Surface Active Agent (*6) | 15 |
| | | Surface Active Agent (*8) | 4 |
| | | Surface Active Agent (*9) | 30 |
| | | Polyvinyl alcohol | 30 |
| | | Lactose | 155 |
| | | Water-Soluble Polymer (*13) | 19 |
| | | Film Hardener (*11) | 37 |
| 3rd layer | Green-sensitive emulsion layer | Green-sensitive silver halide emulsion | 220 in terms of silver |
| | | Fog Inhibitor (*12) | 0.7 |
| | | Gelatin | 370 |
| | | Magenta dye providing compound (2) | 350 |
| | | Electron Donor (*1) | 195 |
| | | Electron Transfer Agent Precursor (*3) | 33 |
| | | High Boiling Solvent (*2) | 175 |
| | | Surface Active Agent (*8) | 47 |
| | | Water-Soluble Polymer (*13) | 11 |
| 2nd layer | Interlayer | Gelatin | 650 |
| | | Zinc hydroxide | 300 |
| | | Electron Donor (*4) | 130 |
| | | High Boiling Solvent (*2) | 50 |
| | | Surface Active Agent (*6) | 11 |
| | | Surface Active Agent (*8) | 4 |
| | | Surface Active Agent (*9) | 50 |
| | | Polyvinyl alcohol | 50 |
| | | Lactose | 155 |
| | | Water-Soluble Polymer (*13) | 12 |
| | | Activated carbon | 25 |
| 1st layer | Red-sensitive emulsion layer | Red-sensitive silver halide emulsion | 230 in terms of silver |
| | | Fog Inhibitor (*12) | 0.7 |
| | | Gelatin | 330 |
| | | Cyan dye providing compound (3) | 340 |
| | | Electron Donor (*1) | 133 |
| | | Electron Transfer Agent Precursor (*3) | 30 |
| | | High Boiling Solvent (*2) | 170 |
| | | Surface Active Agent (*8) | 40 |
| | | Water-Soluble Polymer (*13) | 5 |
| Support: | 96-μm thick polyethylene terephthalate (carbon black layer coated on back side) | | |

Surface Active Agent (*5)

TABLE 1-continued

Electron Donor (*4)

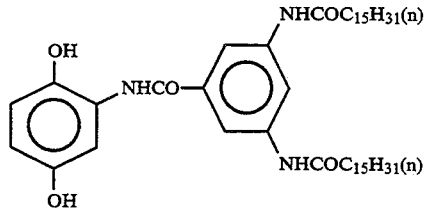

Constitution of light-sensitive Specimen 101

| Layer No. | Layer name | Formulation | Coated amount (mg/m²) |
|---|---|---|---|

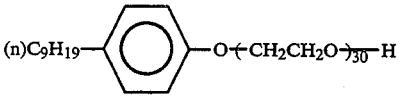

Surface Active Agent (*6)

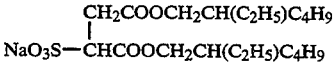

Water-Soluble Polymer (*13)

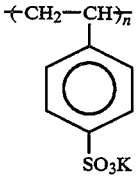

Fog Inhibitor (*7)

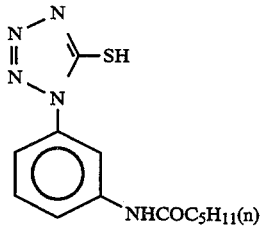

Surface Active Agent (*8)

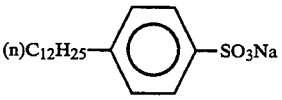

Surface Active Agent (*9)

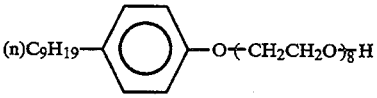

Film Hardener (*11)
1,2-Bis(vinylsulfonylacetamide)ethane
Fog Inhibitor (*12)

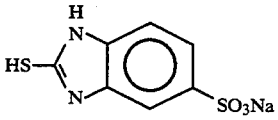

The preparation of a dye fixing element will be hereinafter described.

As set forth in Table E, onto a paper laminated with polyethylene on both sides thereof, were coated the 1st to 3rd layers to prepare a dye fixing Element 101.

TABLE E

| Layer No. | Constitution of dye fixing Element 101 Additive | Added amount (g/m²) |
|---|---|---|
| 3rd layer (Protective layer) | Water-Soluble Polymer (1) | 0.20 |
| | Silicone Oil (1) | 0.04 |
| | Surface Active Agent (1) | 0.001 |
| | Surface Active Agent (2) | 0.02 |
| | Surface Active Agent (3) | 0.10 |
| | Guanidium picolate | 0.45 |
| | Copper carrageenan | 0.06 |
| 2nd layer (Dye fixing layer) | Mordant (1) | 2.35 |
| | Water-Soluble Polymer (1) | 0.20 |
| | Gelatin | 1.40 |
| | Water-Soluble Polymer (2) | 0.60 |
| | High Boiling Solvent (1) | 1.40 |
| | Guanidium picolate | 2.25 |
| | Fluorescent Brightening Agent (1) | 0.05 |
| | Surface Active Agent (5) | 0.15 |
| 1st layer (Subbing layer) | Gelatin | 0.45 |
| | Surface Active Agent (3) | 0.01 |
| | Water-Soluble Polymer (1) | 0.04 |
| | Film Hardener (1) | 0.30 |
| Parper support laminated with polyethylene on both sides. | | |
| Back 1st layer | Gelatin | 3.50 |
| | Film Hardener (1) | 0.25 |
| Back 2nd layer | Gelatin | 0.20 |
| | Silicone Oil (1) | 0.04 |
| | Surface Active Agent (4) | 0.01 |
| | Surface Active Agent (5) | 0.01 |
| | Matting Agent (1) | 0.03 |

Silicone Oil (1)

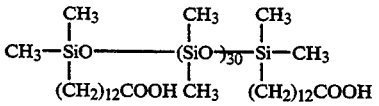

Surface Active Agent (1)

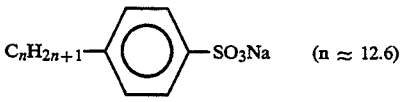

Surface Active Agent (2)

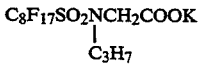

Surface Active Agent (3)

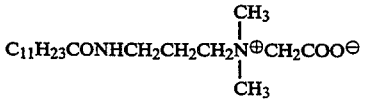

Surface Active Agent (4)

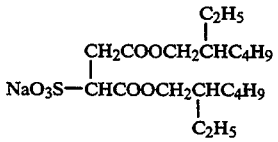

Surface Active Agent (5)

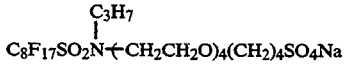

TABLE E-continued

| Layer No. | Constitution of dye fixing Element 101 Additive | Added amount (g/m²) |
|---|---|---|

Mordant (1)

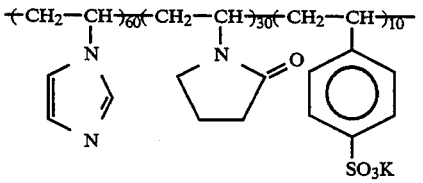

High Boiling Solvent (1)

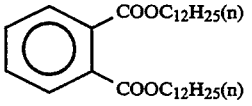

Film Hardener (1)

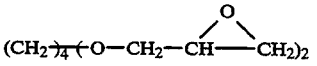

Fluorescent Brightening Agent (1)
2,4-Bis(5-tertiary-butylbenzoxazolyl(2))thiophene
Water-Soluble Polymer (1)
Sumikagel L-5-H (produced by Sumitomo Chemical Co., Ltd.)
Water-Soluble Polymer (2)
Dextran (molecular weight: 70,000)
Matting Agent (1)
Benzoguanamine resin (average grain diameter: 15 μm)

A dye fixing Element 102 was prepared in the same manner as the dye fixing Element 101 except that the back layer was omitted and the formulation of the 2nd layer (dye fixing layer) was as follows:

| (2nd layer of dye fixing Element 102) | (g/m²) |
|---|---|
| Gelatin | 0.8 |
| Water-Soluble Polymer (2) | 0.6 |
| Nipol LX814 (solid content) | 2.0 |
| Mordant (1) | 2.40 |
| Guanidium picolate | 2.20 |
| Fluorscent Brightening Agent (1) | 0.055 |
| Stain Inhibitor (1) | 0.06 |
| High Boiling Solvent (1) | 1.40 |
| Surface Active Agent (4) | 0.025 |

Stain Inhibitor (1)

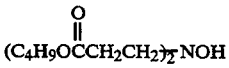

Dye fixing Elements 103 to 113 were prepared in the same manner as the dye fixing Elements 101 and 102, except that compounds set forth in Table F were incorporated in the dye fixing layer and/or protective layer.

Further, dye fixing Elements 114 and 115 were prepared in the same manner as dye fixing Element 102, except that the coated amount of the subbing layer (1st layer) was halved, an interlayer having the same thickness as the subbing layer was provided interposed between the dye fixing layer (2nd layer) and the protective layer (3rd layer), and the compounds set forth in Table F were incorporated therein.

These light-sensitive elements and dye fixing elements were each processed by means of the image recording apparatus disclosed in JP-A-2-84634. Specifically, these light-sensitive elements were each subjected to a scanning exposure of an original image (test chart on which yellow, magenta, cyan and gray wedges having a continuous density gradation had been recorded) through a slit, dipped in water, kept at a temperature of 35° C. for about 5 seconds, squeezed by rollers, and then immediately laminated with the corresponding dye fixing element in such an arrangement that the film surfaces were brought into contact with each other. The laminate was heated for 15 seconds by a heat roller which had been adjusted to heat the surface of the wet film to a temperature of 80° C. When the light-sensitive element was then peeled off the dye fixing material, a sharp color image corresponding to the original image was formed on the dye fixing element.

These dye fixing elements were then measured for maximum transfer density Dmax by means of a Macbeth reflection densitometer. The results are set forth in Table F.

The contact dye transfer of these dye fixing elements were evaluated as follows:

Fully white and black dye fixing elements were prepared by the development of unexposed light-sensitive elements and light-sensitive elements which had been fully exposed to white light, and were combined with dye fixing elements prepared according to the present invention. These dye fixing elements were each moisture-conditioned at a temperature of 35° C. and 80% RH for 1 hour. The fully black dye fixing element and the fully white dye fixing element were then laminated with each other in a face-to-face arrangement. The laminate was then stored under a load of 500 g/20 $cm^2$ at a temperature of 35° C. and 80% RH for 3 days. The two dye fixing elements were peeled off each other. The degree of retransfer of a dye from the fully black dye fixing element to the fully white dye fixing element was evaluated according to the following criteria:

A: Little or no dye transfer
B: Slight dye transfer
C: Much dye transfer
C-B: close to C but better than C
B-C: close to B but worse than B
B-C is better than C-B.

The results are set forth in Table F.

tective layer within the amount specified in the above-mentioned description.

Table F shows that the contact dye transfer can be remarkably eliminated with little or no drop in Dmax by incorporating the borate of the present invention into a protective layer in the dye fixing element.

In accordance with the present invention, a dye fixing element can be provided which can provide a sufficient image density without inhibiting transfer during image formation in an image receiving material which has undergone development or heat development/transfer and does not suffer from "contact dye transfer" even after prolonged storage under high humidity conditions.

While the invention has been described in detail and with reference to specific embodiments thereof, it will be apparent to one skilled in the art that various changes and modifications can be made therein without departing from the spirit and scope thereof.

What is claimed is:

1. A dye fixing element comprising, a support having thereon (i) a dye fixing layer and (ii) a base precursor capable of complexing with metallic ions constituting a difficulty soluble metal salt compound in the presence of water as a medium, said dye fixing layer having a protective layer on the side thereof opposite said support, said protective layer comprising a borate compound and a hydrophilic or water-soluble polymer selected from the group consisting of polysaccharides and derivatives thereof and homopolymers and copolymers comprising monomer units of vinyl alcohol, acrylic acid, salts of acrylic acid, methacrylic acid or salts of methacrylic acid, wherein the dye fixing layer is capable of receiving and having fixed thereto a diffusive dye produced or released by development of a light-sensitive element comprising (i) a light-sensitive silver halide, (ii) a hydrophilic binder, (iii) a difficulty soluble metal salt compound, and (iv) a dye providing compound which releases a diffusive dye in correspondence to or counter correspondence to an imagewise exposure in the presence of a base or base precursor after or simultaneously with the imagewise exposure of the light-sensitive element, and wherein the borate compound is present in the protective layer in an amount sufficient to inhibit contact dye transfer.

TABLE F

| Element No. | Layer into which the compound was incorporated | Compound | Added amount ($g/m^2$) | Dmax Cyan | Dmax Magenta | Dmax Yellow | Contact dye transfer |
|---|---|---|---|---|---|---|---|
| 101 (Comparison) | — | — | — | 2.40 | 2.23 | 2.14 | C-B |
| 102 (Comparison) | — | — | — | 2.35 | 2.18 | 2.10 | C |
| 103 (Invention) | Dye fixing layer | Sodium methaborate | 0.2 | 2.35 | 2.20 | 2.12 | A |
| 104 (Invention) | Protective layer*) | Sodium methaborate | 0.01 | 2.37 | 2.19 | 2.10 | B-C |
| 105 (Invention) | Protective layer*) | Sodium methaborate | 0.02 | 2.35 | 2.16 | 2.12 | B-C |
| 106 (Invention) | Protective layer*) | Sodium methaborate | 0.05 | 2.30 | 2.15 | 2.01 | A |
| 107 (Invention) | Protective layer*) | Sodium methaborate | 0.1 | 2.28 | 2.09 | 2.03 | A |
| 108 (Invention) | Protective layer*) | Sodium methaborate | 0.15 | 2.34 | 2.19 | 2.08 | A |
| 109 (Invention) | Protective layer*) | Sodium methaborate | 0.2 | 2.31 | 2.11 | 2.00 | A |
| 110 (Invention) | Protective layer*) | Borax | 0.05 | 2.33 | 2.15 | 2.09 | A |
| 111 (Invention) | Protective layer*) | Borax | 0.1 | 2.29 | 2.12 | 2.05 | A |
| 112 (Invention) | Protective layer*) | Borax | 0.2 | 2.31 | 2.09 | 1.98 | A |
| 113 (Invention) | Dye fixing layer*) | Borax | 0.2 | 2.32 | 2.10 | 2.02 | A |
| 114 (Invention) | Protective layer | Sodium methaborate | 0.1 | 2.29 | 2.13 | 2.05 | A |
| 115 (Invention) | Protective layer | Borax | 0.1 | 2.30 | 2.15 | 2.08 | A |

*) A part of the borate compound which had been added to the dye fixing layer was diffused into the pro- 2. The dye fixing element of claim 1, wherein the development is heat-development.

3. The dye fixing element of claim 1, wherein the amount of the borate compound is 0.02 to 1.0 g/m$^2$ depending on the dry thickness of the protective layer.

4. The dye fixing element of claim 1, wherein the amount of the borate compound is 0.05 to 0.5 g/m$^2$ depending on the dry thickness of the protective layer.

5. A dye fixing element comprising, a support having thereon (i) a dye fixing layer comprising a mordant and (ii) a base precursor capable of complexing with metallic ions constituting a difficulty soluble metal salt compound in the presence of water as a medium and, said dye fixing layer having a protective layer on the side thereof opposite said support, said protective layer containing a borate compound and a hydrophilic or water-soluble polymer selected from the group consisting of polysaccharides and derivatives thereof and homopolymers and copolymers comprising monomer units of vinyl alcohol, acrylic acid, salts of acrylic acid, methacrylic acid or salts of methacrylic acid, wherein the dye fixing layer is capable of receiving and having fixed thereto a diffusive dye produced or released by heat-development of alight-sensitive element comprising (i) a light-sensitive silver halide, (ii) a difficulty-soluble metallic salt compound comprising metal ions, (iii) a hydrophilic binder, and (iv) a dye providing compound which releases a diffusive dye in correspondence to or counter correspondence to an imagewise exposure in the presence of a base or base precursor after or simultaneously with the imagewise exposure, and wherein the borate compound is present in the protective layer in an amount sufficient to inhibit contact dye transfer.

6. An image-fixing system comprising alight-sensitive element and a dye fixing element, said elements being in planar contact with each other, said light-sensitive element comprising a support having provided thereon alight-sensitive silver halide, a hydrophilic binder, a difficulty soluble metal salt compound, and a dye providing compound which releases a diffusive dye in correspondence to or counter correspondence to an imagewise exposure in the presence of a base or base precursor after or simultaneously with the imagewise exposure of the light-sensitive element, and said dye fixing element comprising a support having thereon (i) a dye fixing layer and (ii) a base precursor capable of complexing with metallic ions constituting a difficulty soluble metal salt compound in the presence of water as a medium, said dye fixing layer having a protective layer on the side thereof opposite said support, said protective layer comprising a borate compound and a hydrophilic or water-soluble polymer selected from the group consisting of polysaccharides and derivatives thereof and homopolymers and copolymers comprising monomer units of vinyl alcohol, acrylic acid, salts of acrylic acid, methacrylic acid or salts of methacrylic acid, wherein said dye fixing layer is capable of receiving and having fixed thereto a diffusive dye produced or released by the development of said light-sensitive element, and wherein the borate compound is present in the protective layer in an amount sufficient to inhibit contact dye transfer.

7. The image-fixing system of claim 6, wherein the development is heat-development.

8. The image-fixing system of claim 6, wherein the light-sensitive element further comprises a reducing agent.

9. The image-fixing system of claim 7, wherein the light-sensitive element further comprises a reducing agent.

10. The image-fixing system of claim 6, wherein the light-sensitive element and the dye fixing element are laminated and adhered to each other.

11. The image-fixing system of claim 6, wherein the amount of the borate compound is in the range of 0.02 to 1.0 g/m$^2$ depending on the dry thickness of the protective layer.

12. The image-fixing system of claim 6, wherein the amount of the borate compound is in the range of 0.05 to 0.5 g/m$^2$ depending on the dry thickness of the protective layer.

* * * * *